US005411850A

United States Patent [19]

Kawabe et al.

[11] Patent Number: 5,411,850

[45] Date of Patent: May 2, 1995

[54] SILVER HALIDE PHOTOGRAPHIC LIGHT-SENSITIVE MATERIAL

[75] Inventors: Satomi Kawabe; Katsuhiko Suzuki; Tomoyuki Nakayama; Hiroyuki Hoshino, all of Hino, Japan

[73] Assignee: Konica Corporation, Japan

[21] Appl. No.: 163,591

[22] Filed: Dec. 7, 1993

Related U.S. Application Data

[63] Continuation of Ser. No. 927,470, Aug. 10, 1992, abandoned.

[30] Foreign Application Priority Data

Aug. 20, 1991 [JP] Japan ..... 3-208212

[51] Int. Cl.[6] ..... G03C 1/035

[52] U.S. Cl. ..... 430/567; 430/569; 430/607

[58] Field of Search ..... 430/567, 569, 607

[56] References Cited

U.S. PATENT DOCUMENTS 4,963,467 10/1990 Ishikawa et al. ..... 430/569

5,166,044 11/1992 Asami ..... 430/567

*Primary Examiner*—Janet C. Baxter

*Attorney, Agent, or Firm*—Jordan B. Bierman; Bierman and Muserlian

[57] ABSTRACT

A silver halide light-sensitive photographic material comprising a support having a silver halide emulsion layer in which an induced absorption peak (a) obtained in a microwave photoconductivity measurement and a peak (b) obtained from the material with a pressure treatment under a prescribed condition satisfies a relation of $b/a \geqq 0.85$, is disclosed. The material shows less pressure desensitizations and high sensitivities.

13 Claims, 1 Drawing Sheet

SILVER HALIDE PHOTOGRAPHIC LIGHT-SENSITIVE MATERIAL

This application is a continuation of application Ser. No. 07/927470, filed Aug. 10, 1992, now abandoned.

FIELD OF THE INVENTION

The present invention relates to a silver halide photographic light-sensitive material, and more particularly to a silver halide photographic light-sensitive material being free from photographic characteristic degradation by pressure and having a high sensitivity.

BACKGROUND OF THE INVENTION

As for silver halide photographic light-sensitive materials, more and more diverse demands have lately been made for improvement of photographic characteristics, particularly for more stable, higher sensitivity, higher image quality and more improved adaptability to rapid processing.

In general, a silver halide light-sensitive material is often desensitized by undergoing physical pressure when contacted with metals or hands (desensitization by friction), which is generally called pressure desensitization, such as when coming into strong contact with transport rollers or others of an automatic processor in processing. The pressure desensitization causes degradation of a photographic image to badly deteriorate the value of it as a photographic product. In order to resolve such shortcomings, U.S. Pat. No. 2,628,167, JP O.P.I. Nos. 116025/1975 and 107,129/1976 describe the addition of a slight amount of an iridium salt or thalium salt to silver halide in the course of its grain formation. However, it is necessary for obtaining a sufficient pressure-desensitization-prevention effect to add a considerable amount of an iridium salt or thalium salt, so that the above slight amount addition has a problem that it results in fall of the sensitivity.

SUMMARY OF THE INVENTION

It is therefore an object of the invention to provide a silver halide photographic light-sensitive material improved to be free from photographic characteristics degradation by pressure (pressure desensitization) and having a high sensitivity.

The above object of the invention is accomplished by a silver halide photographic light-sensitive material in which the induced absorption peak a obtained in the microwave photoconductivity measurement thereof and the induced absorption peak b obtained when subjecting the light-sensitive material to pressure treatment have a relation of $b/a \geqq 0.85$.

DETAILED DESCRIPTION OF TEE INVENTION

Figure 1:
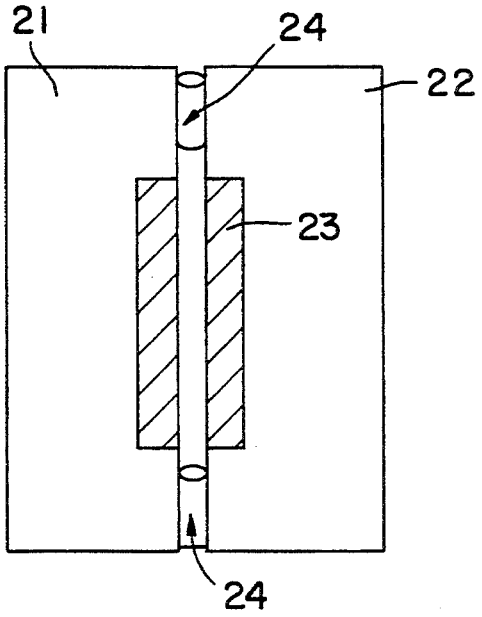
FIG. 1 (PRIOR ART)
FIG. 1 is an explanatory drawing of a folding evaluation device.

The silver halide photographic light-sensitive material of the invention is specified by its characteristics defined in a microwave photoconductivity measurement.

The microwave photoconductivity measurement is a means of evaluating the physical characteristics of a silver halide emulsion, well-known to those skilled in the art, for which reference can be made to, e.g., the method described in, L. M. Kellog, the Photographic Science and Engineering, vol. 18, p. 378 (1974).

The conditions of the microwave photoconductivity measurement made in the invention are described in detail.

The microwave oscillator used in the measurement is a Gunn diode oscillator EGM-10, manufactured by Echo Electronics Co., having a frequency range of 8.5 to 9.5 GHz (X band)) and an output of about 100 mw. The sample cavity resonator used is a $TE_{108}$ mode short-type Resonator ESC/10TS, manufactured by Echo Electronics Co., having a resonance frequency of 9352 Hz, a coupling degree of 40 to 100% variable and a load of $Q>3000$ (when no sample is inserted), and constitutes a wave bridge due to magic T. The sample resonator has a 5 mm×20 mm-size window made on its side. Changes in the conductivity of a light-sensitive material by exposure vary Q of the resonator to unbalance the bridge, and the unbalanced microwave output according to the changes in the sample's conductivity appears at the output terminal of the microwave bridge. This output is subjected to homodyne detection by means of a crystal diode, Crystalmount ECM-10B, manufactured by Echo Electronics Co., and amplified (60 dB amplification; amplifier's frequency band: DC-60 MHz), and then recorded with a waveform recorder to thereby make data processing.

The light-sensitive material to be inserted in the sample resonator is in the form of a 5 mm×20 mm-size film strip, which is positioned in the center of the resonator, with its film plane facing the window, and in parallel with the microwave propagation direction.

A xenon flash lamp (Stroboscope Type MS-230, manufactured by Sugawara Research Institute) was used as a light source to expose the sample. The distance between the lamp's protective glass plate and the window plane of the sample resonator was 18 cm, and a 50 mm-aperture quartz glass lens with a focal length of 100 mm was placed at a point 8 cm away from the window plane to converge the flash light upon the sample for exposure.

In the invention, the intensity of the induced absorption peak in the microwave photoconductivity measurement is defined as follows:

The silver halide light-sensitive material is subjected to microwave photoconductivity measurement in the above manner, and the maximum signal of the microwave induced absorption is converted into a value per mg/100 $cm^2$ of silver coating weight. The converted value is then calibrated with a reference sample and regarded as a peak intensity.

Subsequently, pressure desensitization is evaluated.

As for the pressure treatment there may be used a scratching or pressing method, but an evaluation by way of a folding method is more convenient.

Two 35 mm×145 mm-size sheets of the light-sensitive material are prepared and allowed to stand under conditions of 55% RH/23° C. for a period of 4 hours.

One of the above sheets, after the rehumidification, is subjected to the microwave photoconductivity measurement, and the obtained data is designated as data a. The other is placed with its emulsion side up on the oblique-lined area of the folding evaluation device shown in FIG. 1 thereby to be folded over with its emulsion side in for pressure treatment in which pressure is applied to a 6 mm-wide longitudinal area thereof. FIG. 1 is a plan view of the folding tester, comprising two plates 21 and 22 each of 1.5 cm in thickness pivotably joined with a hinge 24, which each plate has a oblique-lined depression area 25 (for holding a sample) about 2 mm below the other area. In the depression area, a sample is positioned, and folded over by closing plates 21 and 22. The folded sample is taken out from the device, and then allowed to stand for one hour. The pressed area of the sample is cut to 5 mm×120 mm size for the microwave photoconductivity measurement, and the obtained data is designated as data b. The b/a relation is preferably equal to or larger than 0.85.

The invention can be accomplished by reducing the number of silver specks inside silver halide grains to thereby prevent electrons from being trapped to be inactivated inside the grains, and at the same time by making it hard to produce lattice defects by application of pressure.

As means for reducing the number of silver specks inside silver halide grains there are methods in which the process of specks formation up to completion of growth of grains is carried out under an oxidation atmosphere in the presence of a restrainer, and according to an acidic process. Of these the method in which the process of specks formation up to completion of growth of grains is conducted under an oxidation atmosphere is preferred. For this purpose, addition of an oxidation agent or removal of reductive substances is used. As the oxidation agent there may be used generally known oxidation agents such as hydrogen peroxide, nitric acid, nitrous acid, bromine, iodine, and the like. Of these agents the particularly preferred are hydrogen peroxide and iodine.

The use of iodine is preferred in that it has no influence upon photographic characteristics. The adding amount range of iodine is preferably 0.2 to 200 mg per mol of Ag, more preferably 0.5 to 100 mg per mol of Ag.

Iodine may be added as it is or in the form of a solution of it dissolved in water or methanol or a mixture thereof.

The addition of the oxidation agent is made preferably during the time between the speck formation and the growth of grains, more preferably by the initial stage of the growth of grains, and most preferably by the time prior to starting the growth.

For the removal of reductive substances, it is preferable to use a dispersion medium containing little or no reductive substances in the preparation of silver halide grains.

To lessen the reductive substance content of a dispersion medium, there may be used a generally known method of subjecting the medium to hydrogen peroxide treatment.

Measurement of reductive substances is made in the following procedure steps:

(1) Ten grams of gelatin are put in a 250 ml conical flask, and to the gelatin are added 140 ml of water and 4 ml of a 1N sodium hydroxide solution for swelling.
(2) The swelling is made at 10° C. for two hours.
(3) The gelatin is dissolved as soon as possible while gently stirring at 50° C. with care not to cause foaming.
(4) The solution is cooled to 30° C., and to it are added the following reagents in the following steps:
   a. 8 ml of a sulfamic acid solution are added, and stirred,
   b. 6 ml of a sulfuric acid solution are added, and stirred,
   c. 10 ml of a potassium iodide solution are added,
   d. 2 to 3 ml of a fresh 1% starch solution are added,
   e. thoroughly stirred, and
   f. titration is made with a 0.01N iodine solution.

The reagents used in the above a. to f. were prepared as follows:

| | |
|---|---|
| Sulfamic acid | 25 g/liter |
| Sulfuric acid | 20% w/w |
| Potassium iodide | 25 g/liter |

If the amount of the 0.01N iodine solution used in titration is n ml, the reductive substance content of a dispersion medium, in terms of an amount (mg) of $SO_2$ contained in 1 kg of gelatin, is expressed by the following equation:

$$SO_2=(32\times n)\ mg/kg$$

The reductive substance content in terms of $SO_2$ is preferably 15 to 5 ppm.

Non-reductive substances contained in a dispersion medium are preferably those having as small an amount of heavy-metallic ions as possible; e.g., Fe is in an amount of preferably 0 to 40 ppm, more preferably not more than 10 ppm, and most preferably not more than 4 ppm; $NO_3^-$ is in preferably 500 to 15000 ppm, more preferably 1000 to 10000 ppm, and most preferably 2000 to 8000 ppm; and Ca is in preferably 100 to 8000 ppm, and more preferably 2000 to 6000 ppm.

The use of a dispersion medium containing little or no reductive substances is made during the period preferably from the beginning up to completion of the growth of grains, more preferably from completion of the speck formation up to completion of the growth of grains, and most preferably between the silver speck formation and completion of the growth of grains.

The two means for the addition of the oxidation agent for making an oxidation atmosphere and for the removal of the reductive substance from the dispersion medium may be used alone of in discretional combination. More preferred is the use of the two means in combination in respect that it can create a better oxidation atmosphere.

The silver halide of the emulsion of the invention may be silver bromide, silver bromoiodide, silver chloride, silver chlorobromoiodide or a mixture thereof.

There are known neutral, acidic and ammoniacal methods for the preparation of silver halide. A method for preparing silver halide by use of an ammoniacal silver nitrate solution is called the ammoniacal method. The silver halide emulsion of the invention may be prepared according to the ammoniacal method. In this method, a silver halide emulsion is prepared normally under a high pH condition; pH of the ammoniacal silver nitrate solution for preparing the emulsion of the invention is preferably less than 10.5, more preferably not more than 10.0. And pH of the silver halide emulsion at the time of its preparation is not less than 1 and less than 8, more preferably not less than 2 and less than 7.5, and most preferably not less than 5 and less than 7.5.

In the preparation of the silver halide emulsion of the invention, it is preferable to use either a method for supplying halide ions in the form of an aqueous solution of an alkali halide such as KI, NaI, KBr or NaBr or a mixture of solutions thereof or a method for providing a fine-grained silver halide.

The preferred embodiment of the invention is such that the surface phase, low-iodide content phase and high-iodide content phase of the silver halide grain, more preferably a part or the whole of all the phases constituting the silver halide grain, is provided by a fine grain supply method. Further in the above, preferably not less than 60% of, more preferably not less than 80% of, and most preferably the whole of the grain is formed by the fine grain supply method.

The method for silver halide grain formation by the supply of fine-grained silver halide includes two ways; one in which silver halide fine grains alone are supplied, while the other in which the supply of silver halide fine grains is accompanied by the supply of halide and silver salt solutions as described in JP O.P.I. No. 167537/1990. In order to increase the uniformity of silver halide grains, the supply of silver halide fine grains alone is particularly preferred.

The method of forming the surface phase of silver halide grains is not particularly restricted except that a part or the whole of the surface phase be formed with use of fined-grained silver halide. For example, a desired silver iodide content-having silver halide fine grains may be used so as to make the silver iodide content of the surface phase higher than that of the inner phase adjacent to the surface phase. Also, silver iodide fine grains may be used alone or, in order to obtain a desired silver iodide content, used in a mixture thereof with different other silver halide composition-having silver halide fine grains. The surface phase may be formed following the formation of the silver halide grains, the parent to form the surface phase, or after the preparation of the parent grains, e.g., before, during or after the desalting, washing or chemical sensitization thereof. A crystal habit control agent may also be used in order to form a high silver iodide content surface phase only in a specific area of the surface of the parent grain.

The surface phase formation may be made either at a time or by installments.

The grain diameter of the silver halide fine grains to be supplied during the formation of light-sensitive silver halide grain specks and/or the growth of grain crystals is preferably not more than 0.1 μm, more preferably not more than 0.05 μm, and most preferably not more than 0.03 μm. The grain diameter of the silver halide grain can be obtained by actually measuring the diameter of an electron-microscopically photographed grain image magnified 30,000 to 60,000 times, or measuring the area of a magnifiedly projected grain image.

The silver halide fine grains to be added may be prepared (a) prior to or (b) in parallel with the light-sensitive silver halide grain specks formation and/or the crystal growth.

In the case of (b), because of its short time-lag between the generation of silver halide grain specks and the addition of the silver halide fine grains, it can restrain the increase in the fine grain size due to inter-fine-grain Ostwald ripening. Particularly, such the manner of continuously adding while preparing silver halide grains is effective in shortening the above time-lag.

Where the light-sensitive silver halide grain has at least one phase consisting of a mixed crystal composed of two or more different silver halides and in the case of forming the phase by the supply of silver halide fine grains, the formation of the phase may be made by (1) using silver halide fine grains having a silver halide composition according to the halide composition of the objective silver halide grains, or (2) adding two or more silver halide grains having different silver halide compositions simultaneously or separately in a mixing proportion according to the silver halide composition of the objective silver halide grains.

The method of supplying the silver halide grains, the silver halide composition of and additives to the fine grains are not restricted; any discretional combination of them may be used in the preparation of the silver halide emulsion of the invention.

However, in the case where the light-sensitive silver halide grain has at least two phases different in the silver halide composition and where at least two of the phases are formed by the supply of silver halide fine grains, if the supply of the silver halide fine grains comprises with (a), combination of (2) therewith is preferred from the viewpoint of production efficiency.

It is important to make still smaller the grain size of the fine grains to be supplied for increasing the solubility thereof. It is possible to lower the preparation temperature of the fine grains by using a less-gelling dispersion medium as a protective colloid in the preparation of the fine grains, whereby the grain size of the fine grains can be made further smaller.

The 'less-gelling dispersion medium' herein means a dispersion medium which is hard to be gelled (set) as compared to photographic gelatin for general use (having an average molecular weight of more than 70,000) and includes (A) low-molecular gelatin and (B) natural high-molecular compounds other than synthetic high-molecular compound and gelatin, having a protective colloid characteristic to silver halide grains.

It is preferable to use a monodisperse silver halide emulsion for the silver halide photographic light-sensitive material of the invention. The monodisperse silver halide emulsion is one in which the weight of its silver halide grains whose grain diameters fall within the range of their average grain diameter ±20% accounts for preferably not less than 70%, more preferably not less than 80%, and most preferably not less than 90% of the whole weight of the silver halide grains.

The monodisperse emulsion used in the invention has a grain diameter distribution width of preferably not more than 20%, more preferably not more than 15%, the grain diameter distribution width being defined by $$\frac{\text{Standard deviation of grain diameters}}{\text{Average grain diameter}} \times 100$$

The average grain diameter of the silver halide emulsion of the invention is preferably 0.1 to 10 μm, more preferably 0.1 to 5.0 μm.

The grain diameter mentioned above is the diameter of a circumcircle to the area in which a projection image of a grain becomes maximum.

The silver halide emulsion of the invention is preferably a silver iodobromide emulsion, but it may contain silver chloride within limits not to impair the effect of the invention.

The emulsion of the invention is preferably one comprising core/shell-type silver halide grains, such as the definite multistructure-type grains described in JP O.P.I. Nos. 14844/1986 and 245151/1986.

The definite core/shell-type multistructure can be clarified by utilizing the method described in, e.g., H.

Hilsh, the Journal of Photographic Science, vol. 10, p. 129 (1962).

According to this method, that a grain has a definite core/shell structure means that the diffraction curve of the grain substantially has two diffraction peaks. The emulsion of the invention is preferably an emulsion comprising a grain of a structure having one diffraction signal peak corresponding to the low-iodide content region and another corresponding to the internal high-iodide content region, wherein the strength of the diffraction signal peak corresponding to the high-iodide content region is 1/10 to 3/1 of that of the peak in the low-iodide content region.

The silver halide grain of the emulsion of the invention has thereinside a high silver iodide content phase. The silver iodide content of this phase is preferably 15 to 45 mol. %, more preferably 20 to 42 mol. %, and most preferably 25 to 40 mol. %.

The silver halide grain having thereinside a high silver iodide content phase in the invention is one in which the high silver iodide content phase is covered with a low silver iodide content phase having a silver halide content lower than that of the former.

The average silver iodide content of the outermost phase having a lower silver iodide content than the high silver iodide content phase is preferably not more than 6%, more preferably 0 to 4 mol. %. A silver iodide-containing phase as an intermediate phase may be present between the outermost phase and the high silver iodide content phase.

The silver iodide content of the intermediate phase is preferably 10 to 22 mol. %, more preferably 12 to 20 mol. %.

The difference in the silver iodide content between the outermost phase and the intermediate phase and between the intermediate phase and the inside high silver iodide content phase is preferably not less than 6 mol. %, more preferably not less than 10 mol. %.

There may be present still other silver halide phases, one each in the core of the inside high silver iodide content phase, between the inside high silver iodide content phase and the intermediate phase, and between the intermediate phase and the outermost phase.

The volume of the outermost phase accounts for preferably 4 to 70%, more preferably 10 to 50% of the whole volume of the grain. The volume of the high silver iodide content phase accounts for preferably 10 to 80%, more preferably 20 to 45% of the entire volume of the whole volume of the grain. The volume of the intermediate phase accounts for preferably 5 to 60%, more preferably 5 to 60%, more preferably 20 to 55% of the whole volume of the grain.

These phases each may be a single phase of a uniform composition; these may be a group of phases having uniform but stepwise-changing compositions; an arbitrary one of these phases may be a continuous phase having a continuously changing composition; or the grain may be composed of a combination of these different phases.

Another embodiment of the silver halide emulsion of the invention is such that the silver iodide present locally inside the grain does not form a substantially uniform phase but its content continuously changes from the core toward the outside of the grain. In this instance, it is preferable that the silver iodide content monotonously reduce from its maximum content point toward the outside of the grain.

The silver iodide content at its maximum content point is preferably 15 to 45 mol. %, more preferablyu 25 to 40 mol. %.

The silver iodide content of the surface phase of the grain is preferably not more than 6 mol. %, more preferably 0 to 4 mol. %.

The silver halide emulsion of the invention preferably satisfy at least one of the following requirements (1) to (4):

(1) The emulsion is required to satisfy a relation of $J_1 > J_2$, wherein $J_1$ represents the average silver iodide content of the grain found by X-ray fluorescence analysis, and $J_2$ represents the silver iodide content of the grain surface phase found by X-ray photoelectron spectroanalysis.

The X-ray photoelectron spectroanalysis is explaned.

The emulsion is subjected to the following treatment prior to undergoing measurement according to X-ray photoelectron spectroanalysis. The emulsion, after adding a pronase solution thereto, is stirred at 40° C. for one hour for decomposition of gelatin; centrifuged for sedimentation of gelatin; the supernatant is decanted off; a pronase solution is added again thereto to make redecomposition of gelatin, followed by subjecting the sample to centrifugation again for decantation; and then the emulsion grains are redispersed in distilled water, and centrifuged for decantation, thus repeating the above steps three times. After that, the emulsion grains are redispersed in ethanol, and this dispersion is then thinly coated on a mirror-like polished silicone wafer to thereby prepare a sample for measurement.

The X-ray photoelectron spectroanalysis is carried out by using an analyser such as, e.g., an ESCA/-SAM560, manufactured by PHI, which uses Mg-K$\alpha$ rays as its excitation X-ray source under conditions of X-ray source voltage: 15 KV, X-ray source current: 40 mA, and pass energy: 50 eV.

To find the surface phase halide composition, Ag3d, Br3d and I3d3/2 electrons are detected. The composition ratio's calculation is conducted according to a relative speed coefficient method with use of the integrated strengths of the respective signal peaks. The composition ratio is given in terms of atomic percentages by use of 5.10, 0.81 and 4.592 as the relative speed coefficients of Ag3d, Br3d and I3d3/2, respectively.

(2) The emulsion is to satisfy the relation of $J_1 > J_3$, wherein $J_1$ represents the average silver iodide content found by the foregoing X-ray fluorescence analysis, and $J_3$ represents the average of silver iodide content values measured on the silver halide crystal 80% away from the core in the grain diameter direction of the silver halide grain according to an X-ray microanalysis method.

The X-ray microanalysis method is explained. Silver halide grains are dispersed in the electron-microscopic observation grid of an energy dispersion-type X-ray analizer equipped to an electron microscope, and the the electron microscope's magnification is set so as to get one single grain full in the CRT field of view while cooling the grain by liquid nitrogen to make integration of the strengths of AgL$\alpha$ and IL$\alpha$ rays for a specified period of time, from which the silver iodide content of the grain, with use of an in advance prepared IL$\alpha$/AgL$\alpha$ strength ratio calibration curve, can be calculated.

(3) In an X-ray diffractometry which uses CuK$\alpha$ ray as an X-ray source, the emulsion is to be characterized by having a signal continuously present over a diffraction angle of not less than 1.5, preferably not less than 1.8 and more preferably not less than 2.0 at the maximum peak height ×0.13, preferably ×0.15, of (420) X-ray diffraction signal. That the signal is present means that at the maximum peak height ×0.13 or ×0.15 the signal has a higher strength than the height.

A still more preferred embodiment of the silver halide emulsion of the invention is such that in its diffractometry with CuKα rays as an X-ray source the (420) X-ray diffraction signal has two or three signal peaks, more preferably three peaks.

The X-ray diffractometry is known as a means for examination of the crystal structure of silver halide.

As the X-ray source for the X-ray diffractometry there may be used various characteristics-having X-rays may be used. Above all, CuKα ray generated with Cu as a target is most widely used.

Silver iodobromide has a rock salt structure, and its (420) diffraction angle by CuKα ray is observed to be 2θ71 to 74 degrees. The CuKα-ray diffractometry provides a relatively strong signal at a high diffraction angle, so that it has a good resolution and most suitable for crystal structure examination.

For the X-ray diffractometry measurement, the photographic emulsion, after removing its gelatin therefrom, needs to be mixed with reference sample such as silicon and measured according to a powder method.

For the above measurement reference can be made to the 'X-Ray Analysis' in the Basic Course of Analytical Chemistry 24 (Kyoritsu Shuppan).

(4) When the average of the silver iodide content values of the individual silver halide grains of the emulsion of the invention according to the foregoing X-ray microanalysis method, the relative standard deviation of the measured values is to be preferably not more than 20%, more preferably not more than 15%, and most preferably not more than 12%.

The average standard deviation herein is defined by $$\frac{\text{Standard deviation of AgI content values of, e.g., at least 100 AgX emulsions}}{\text{Average AgI content}} \times 100$$

The silver halide emulsion grain of the invention may be a regular crystal such as a cubic, tetradecahedral or octadecahedral crystal, or a tabular twin, or a mixture of these crystals.

In the case of the tabular twin, the emulsion is preferably one in which the number of its grains each with a diameter of a circle corresponding to the projection image thereof/grain thickness ratio of 1 to 20 accounts for preferably not less than 60% of the whole number of projected grains, and the diameter/thickness ratio is more preferably not less than 1.2 and less than 8.0, and most preferably not less than 1.5 and less than 5.0.

The monodisperse regular crystal emulsion may be produced by making reference to the methods disclosed in JP O.P.I. Nos. 177535/1984, 138535/1985, 52238/1984, 145331/1985, 35726/1985, 258536/1985 and 14636/1986.

The monodisperse twin crystal emulsion may be produced by making reference to the method for growing spherical seed grains disclosed in JP O.P.I. No. 14636/1986.

In the growth of seed grains it is preferable to add an aqueous silver nitrate solution and an aqueous halide solution according to a double-jet method. The iodide may be added in the form of silver iodide to be supplied in the system. The addition should be made at a rate not to produce new nuclei and nor to cause any grain size distribution extent due to Ostwald ripening, i.e., at a rate in the range of 30 to 100% of the rate producing new nuclei.

The formation or physical ripening of silver halide grains may be carried out in the presence of a cadmium salt, zinc salt, lead salt, thalium salt, iridium salt or complex salt thereof, rhodium salt or complex salt thereof, or iron salt or complex salt thereof.

There is another method of growing grains in which the growth of grains is carried out by the addition, dissolution and recrystalization of silver halide fine grains as seen in the book of the gists of papers delivered to the annual convention '83 of The Society of Photographic Science and Technology of Japan.

The growth of silver halide emulsion grains is performed under conditions of preferably a pAg of 5 to 11, a temperature of 40° to 85° C. and pH of 1.5 to 12.

The silver halide emulsion of the invention is subjected to physical ripening, chemical sensitization and spectral sensitization. The additives and couplers to be used in these processes are described in Research Disclosure (hereinafter abbreviated to RD) Nos. 17643, 18716 and 308119.

The additives used in the invention may be according to the dispersing method described in RD308119XIV.

As the support to be used in the invention there may be used one of those described in p. 28 of RD 17643, p. 647–8 of RD18716 and XVII of RD308119.

The light-sensitive material of the invention may have auxiliary layers such as filter layers, intermediate layers and the like as described in RD308119, sec. VII-K.

The light-sensitive material of the invention may take various layer structures such as normal layer structure, inverted layer structure and unit layer structure as described in RD308119, sec. VII-K.

The invention may apply to various color photographic light-sensitive materials such as color negative films for general or movie use, color reversal films for slide or TV use, color photographic papers, color positive films and color reversal papers.

The light-sensitive material of the invention may be processed in the usual manner as described in p. 28–29 of RD17643, p. 647 of RD18716 and XVII of RD308119.

EXAMPLES

The present invention is further detailed by the following examples.

Preparation of Comparative Emulsion Em-A

The following solutions were used to prepare a comparative silver halide emulsion, comprising silver halide regular octahedral grains having an average grain diameter of 1.0 μm and an average silver iodide content of 8.0 mol. %.

Seed Emulsion (average grain diameter: 0.27 μm, average silver iodide content: 2 mol. %)

Silver halide: amount equivalent to 0.206 mol, the same shall apply hereinafter.

| Solution A-1: | |
|---|---|
| Osein gelatin | 235.87 g |
| Sodium polyisopropylenedisuccinate (10% ethanol solution) | 30 ml |

-continued

| | |
|---|---|
| Water | 9150.7 ml |
| 56% acetic acid solution | 1500 ml |
| 28% aqueous ammonia solution | 1056 ml |
| Solution B-1: | |
| Osein gelatin | 160 g |
| Potassium bromide | 1666.1 g |
| Water | 3275.6 ml |
| Solution C-1: | |
| Silver nitrate | 1679 g |
| 28% aqueous ammonia solution | 1369.6 ml |
| Add distilled water to make | 2823.5 ml |
| Solution D-1: | |
| Silver iodide emulsion (average grain diameter: 0.060 μm) | 0.84 mol |
| 4-Hydroxy-6-methyl-1,3,3a,7-tetrazaindene (hereinafter called TAI) | 5.22 g |
| Add distilled water to make total | 1280 ml |
| Solution E-1: | |
| 20% potassium bromide solution amount necessary to adjust pAg | |

Solution F-1:

56% acetic acid solution amount necessary to adjust pH

Using the above solutions, an emulsion was prepared in the following manner: At 60° C. to Solution A-1 was added the seed emulsion, and also added Solutions B-1, C-1 and D-1, while controlling pH, pAg and flow rates as shown in Tables 1 and 2, according to a double-jet method by using a mixing stirrer that is described in JP O.P.I. Nos. 92523/1982 and 92524/1982.

The controls of pAg and pH during the double-jet addition of the solutions were made by changing the flow rates of Solutions E-1 and F-1 with a flow rate-variable roller tube pump.

The formed grains were washed according to the method described in Japanese Patent Application No. 4003/1990, then gelatin was added thereto and redispersed, and pH and pAg were adjusted to 5.8 and 8.06, respectively, and then water was added to make the whole volume 4500 ml, whereby an emulsion Em-A was prepared.

Preparation of Comparative Emulsion Em-C:

Emulsion Em-C was prepared in quite the same manner as in Em-A except that 25.5 ml/mol of Ag of iodine were added to Solution A one minute before the addition of the seed emulsion in the preparation of the emulsion Em-A.

Preparation of Comparative Emulsion Em-D:

Emulsion Em-D was prepared in quite the same manner as in Em-A except that the gelatin of Solutions A-1 and B-1 was replaced by an inert gelatin containing $SO_2$-equivalent 15 ppm of a reductive substance, 4400 ppm of $NO_3$, 4990 ppm of Ca and 1.0 ppm of Fe.

Preparation of Comparative Emulsion Em-B:

Emulsion Em-B was prepared in quite the same manner as in Em-A except that $10^{-6}$ mol/Ag of a potassium hexachloroiridate was added before completion of the growth of grains.

The osein gelatin used in Solutions A-1 and B-1 is a gelatin containing $SO_2$-equivalent 17 ppm of a reductive substance, 70 ppm of $NO_3$, 100 ppm of Ca and 5 ppm of Fe.

TABLE 1

| Time(min.) | 0 | 110 | 111 | 123 | 138 | 146 | 163 |
|---|---|---|---|---|---|---|---|
| pH | 7.0 | 7.0 | 6.0 | 6.0 | 6.0 | 6.0 | 6.0 |

TABLE 1-continued

| Time(min.) | 0 | 110 | 111 | 123 | 138 | 146 | 163 |
|---|---|---|---|---|---|---|---|
| pAg | 7.8 | 7.8 | 9.7 | 9.8 | 10.0 | 10.1 | 10.1 |

Note: represents maintaining pH and pAg constant.
represents changing pH and pAg slowly.
represents abruptly changing pH and pAg.

TABLE 2

| Time (min.) | Solution's adding rate (ml/min.) | | |
|---|---|---|---|
| | Solution C-1 | Solution B-1 | Solution D-1 |
| 0 | 5.5 | 5.8 | 0 |
| 27.5 | 6.3 | 6.6 | 0 |
| 54.9 | 4.5 | 4.7 | 24.1 |
| 76.9 | 5.6 | 5.8 | 29.9 |
| 95.2 | 6.5 | 6.8 | 9.9 |
| 110.9 | 17.6 | 10.5 | 11.1 |
| 123.5 | 30.0 | 16.4 | 4.8 |
| 132.3 | 40.8 | 23.5 | 6.9 |
| 138.6 | 61.3 | 32.2 | 9.5 |
| 143.2 | 93.8 | 44.4 | 13.1 |
| 146.7 | 61.1 | 55.6 | 16.4 |
| 149.5 | 68.7 | 62.6 | 18.4 |
| 152.2 | 72.6 | 66.2 | 19.5 |
| 154.7 | 76.4 | 69.6 | 20.5 |
| 157.2 | 80.1 | 73.0 | 21.5 |
| 163.1 | 90.7 | 84.2 | 0 |

Preparation of Emulsion Em-E of the Invention

Emulsion EM-E was prepared in quite the same manner as in emulsion Em-A except that 50 ml of methanol containing 0.001 mol of iodine was added one minute before the addition of the seed emulsion, and the gelatin contained in Solutions A-1 and B-1 was replaced by the inert gelatin used in Em-D.

Preparation of Multilayer Color Light-Sensitive Material Samples

The foregoing emulsion Em-A, after being chemically and spectrally sensitized by adding sodium thiosulfate, chloroauric acid, sensitizing dyes, stabilizers and antifoggrants thereto, was used to prepare a multilayer color light-sensitive material sample 101, having the following layers coated on a subbed triacetyl cellulose film of 123μ in thickness.

In the following layers the amounts of the consituents are shown in grams per $m^2$ except that those of sensitizing dyes are in mols per mol of silver.

| | mol/mol Ag |
|---|---|
| Layer 1: Antihalation layer (HC) | |
| Black colloidal silver | 0.16 |
| UV absorbent UV-1 | 0.20 |
| High-boiling solvent Oil-1 | 0.16 |
| Gelatin | 1.23 |
| Layer 2: Intermediate layer (IL-1) | |
| Compound SC-1 | 0.15 |
| High-boiling solvent Oil-2 | 0.17 |
| Gelatin | 1.27 |
| Layer 3: | |
| Low-speed red-sensitive emulsion layer (RL) | |
| Silver iodobromide emulsion (average grain diameter: 0.38 μm, AgI content: 8.0 mol % ) | 0.50 |
| Silver iodobromide emulsion (average grain diameter: 0.27 μm, AgI content: 2.0 mol %) | 0.21 |
| Sensitizing dye SD-1 | $2.8 \times 10^{-4}$ |
| Sensitizing dye SD-2 | $1.9 \times 10^{-4}$ |
| Sensitizing dye SD-3 | $1.9 \times 10^{-5}$ |
| Sensitizing dye SD-4 | $1.0 \times 10^{-4}$ |
| Cyan coupler C-1 | 0.48 |
| Cyan coupler C-2 | 0.14 |
| Colored cyan coupler CC-1 | 0.02 |
| DIR compound D-1 | 0.02 |
| High-boiling solvent Oil-1 | 0.53 |

-continued

| | mol/mol Ag |
|---|---|
| Gelatin | 1.30 |
| Layer 4: | |
| Medium-speed red-sensitive emulsion layer (RM) | |
| Silver iodobromide emulsion (average grain diameter: 0.52 μm, AgI content: 8.0 mol %) | 0.62 |
| Silver iodobromide emulsion (average grain diameter: 0.38 μm, AgI content: 8.0 mol %) | 0.27 |
| Sensitizing dye SD-1 | $2.3 \times 10^{-4}$ |
| Sensitizing dye SD-2 | $1.2 \times 10^{-4}$ |
| Sensitizing dye SD-3 | $1.6 \times 10^{-5}$ |
| Sensitizing dye SD-4 | $1.2 \times 10^{-4}$ |
| Cyan coupler C-1 | 0.15 |
| Cyan coupler C-2 | 0.18 |
| Colored cyan coupler CC-1 | 0.030 |
| DIR compound D-1 | 0.013 |
| High-boiling solvent Oil-1 | 0.30 |
| Gelatin | 0.93 |
| Layer 5: | |
| High-speed red-sensitive emulsion layer (RH) | |
| Silver iodobromide emulsion Em-A | 1.27 |
| Sensitizing dye SD-1 | $1.3 \times 10^{-4}$ |
| Sensitizing dye SD-2 | $1.3 \times 10^{-4}$ |
| Sensitizing dye SD-3 | $1.6 \times 10^{-5}$ |
| Cyan coupler C-2 | 0.12 |
| Colored cyan coupler CC-1 | 0.013 |
| High-boiling solvent Oil-1 | 0.14 |
| Gelatin | 0.91 |
| Layer 6: Intermediate layer IL-2 | |
| Compound SC-1 | 0.09 |
| High-boiling solvent Oil-2 | 0.11 |
| Gelatin | 0.80 |
| Layer 7: | |
| Low-speed green-sensitive emulsion layer (GL) | |
| Silver iodobromide emulsion (average grain diameter: 0.38 μm, AgI content: 8.0 mol %) | 0.61 |
| Silver iodobromide emulsion (average grain diameter: 0.27 μm, AgI content: 2.0 mol %) | 0.20 |
| Sensitizing dye SD-4 | $7.4 \times 10^{-5}$ |
| Sensitizing dye SD-5 | $6.6 \times 10^{-4}$ |
| Magenta coupler M-1 | 0.18 |
| Magenta coupler M-2 | 0.44 |
| Colored magenta coupler CM-1 | 0.12 |
| High-boiling solvent Oil-2 | 0.75 |
| Gelatin | 1.95 |
| Layer 8: Medium-speed green-sensitive emulsion layer (GM) | |
| Silver iodobromide emulsion (average grain diameter: 0.59 μm, AgI content: 8.0 mol %) | 0.87 |
| Sensitizing dye SD-6 | $2.4 \times 10^{-4}$ |
| Sensitizing dye SD-7 | $2.4 \times 10^{-4}$ |
| Magenta coupler M-1 | 0.058 |
| Magenta coupler M-2 | 0.13 |
| Colored magenta coupler CM-1 | 0.07 |
| DIR compound D-2 | 0.025 |
| DIR compound D-3 | 0.002 |
| High-boiling solvent Oil-2 | 0.50 |
| Gelatin | 1.0 |
| Layer 9: | |
| High-speed green-sensitive emulsion layer (GH) | |
| Silver iodobromide emulsion Em-A | 1.27 |
| Sensitizing dye SD-6 | $1.4 \times 10^{-4}$ |
| Sensitizing dye SD-7 | $1.4 \times 10^{-4}$ |
| Magenta coupler M-2 | 0.84 |
| Magenta coupler M-3 | 0.064 |
| Colored magenta coupler CM-1 | 0.012 |
| High-boiling solvent Oil-1 | 0.27 |

-continued

| | mol/mol Ag |
|---|---|
| High-boiling solvent Oil-2 | 0.012 |
| Gelatin | 1.0 |
| Layer 10: Yellow filter layer (YC) | |
| Yellow colloidal silver | 0.08 |
| Antistain agent SC-2 | 0.15 |
| High-boiling solvent Oil-1 | 0.19 |
| Gelatin | 1.10 |
| Formalin scavenger HS-1 | 0.20 |
| Layer 11: Intermediate layer (IL-3) | |
| Formalin scavenger HS-1 | 0.20 |
| Gelatin | 0.60 |
| Layer 12: | |
| Low-speed blue-sensitive emulsion layer (BL) | |
| Silver iodobromide emulsion (average grain diameter: 0.38 μm, AgI content: 8.0 mol %) | 0.22 |
| Silver iodobromide emulsion (average grain diameter: 0.27 μm, AgI content: 2.0 mol %) | 0.03 |
| Sensitizing dye SD-8 | $4.9 \times 10^{-4}$ |
| Yellow coupler Y-1 | 0.75 |
| High-boiling solvent Oil-2 | 0.30 |
| Gelatin | 1.20 |
| DIR compound D-1 | 0.01 |
| Layer 13: | |
| Medium-speed blue-sensitive emulsion layer (BM) | |
| Silver iodobromide emulsion (average grain diamter: 0.59 μm: AgI content: 8.0 mol %) | 0.30 |
| Sensitizing dye SD-8 | $1.6 \times 10^{-4}$ |
| Sensitizing dye SD-9 | $7.2 \times 10^{-5}$ |
| Yellow coupler Y-1 | 0.10 |
| DIR compound D-1 | 0.01 |
| High-boiling solvent Oil-2 | 0.046 |
| Gelatin | 0.47 |
| Layer 14: | |
| High-speed blue-sensitive emulsion layer (BH) | |
| Silver iodobromide emulsion Em-A | 0.85 |
| Sensitizing dye SD-8 | $7.3 \times 10^{-5}$ |
| Sensitizing dye SD-9 | $2.8 \times 10^{-5}$ |
| Yellow coupler Y-1 | 0.11 |
| High-boiling solvent Oil-2 | 0.0046 |
| Gelatin | 0.8 |
| Layer 15: First protective layer (Pro-1) | |
| Silver iodobromide emulsion (average grain diameter: 0.08 μm, AgI content: 1.0 mol %) | 0.40 |
| UV absorbent UV-1 | 0.065 |
| UV absorbent UV-2 | 0.10 |
| High-boiling solvent Oil-1 | 0.07 |
| High-boiling solvent Oil-3 | 0.07 |
| Formalin scavenger HS-1 | 0.40 |
| Gelatin | 1.31 |
| Layer 16: Second protective layer (Pro-2) | |
| Alkaline matting agent (average particle diameter: 2 μm) | 0.15 |
| Polymethyl methacrylate (average particle diameter: 3 μm) | 0.04 |
| Lubricant WAX-1 | 0.55 |
| Gelatin | 0.55 |

In addition to the above additives, to each layer were added coating aid Su-1, dispersion assistant Su-2, viscosity adjusting agent, hardeners H-1 and H-2, stabilizer ST-1, antifoggant AF-1, AF-2 of an average molecular weight of 10,000, AF-2 of an average molecular weight of 1,100,000, and preservative DI-1, wherein DI-1 was added in an amount of 9.4 mg/m$^2$.

C-1

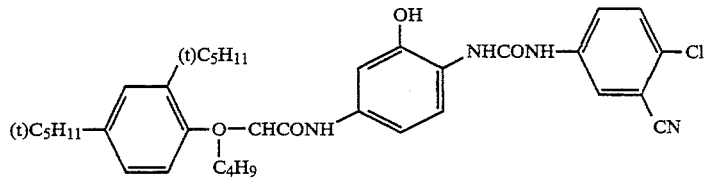

-continued
C-2
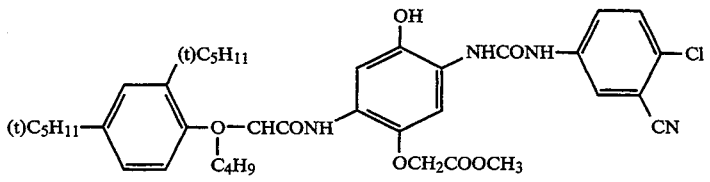
M-1
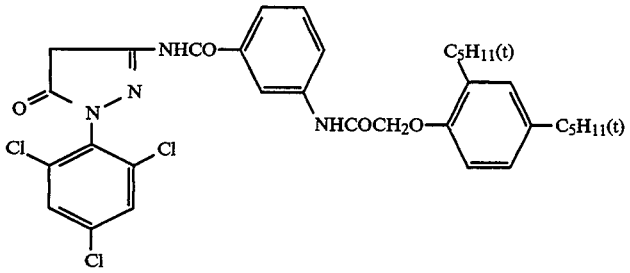
M-2
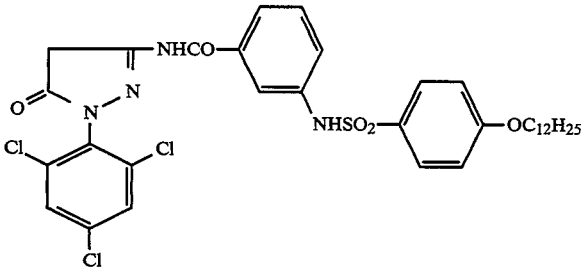
M-3
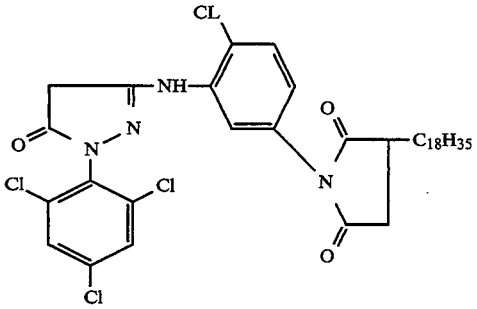
Y-1
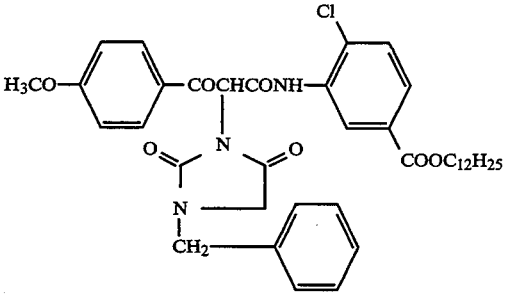

-continued
CC-1
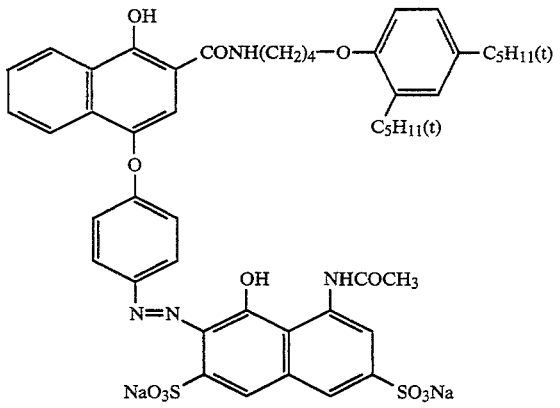
CM-1
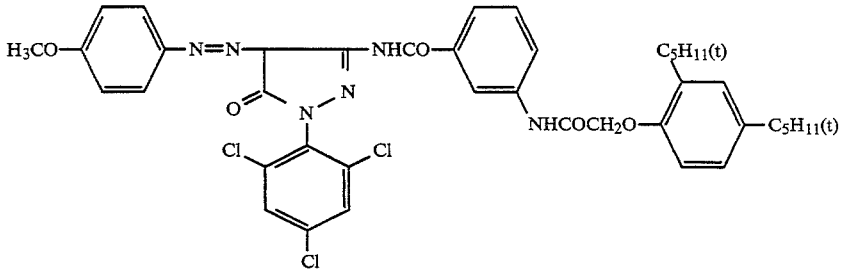
D-1
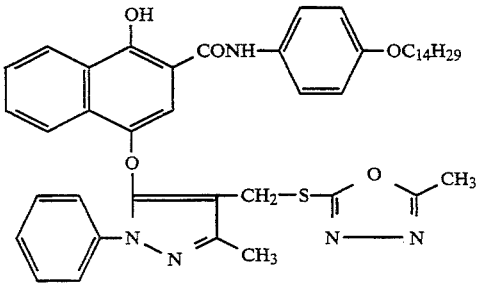
D-2
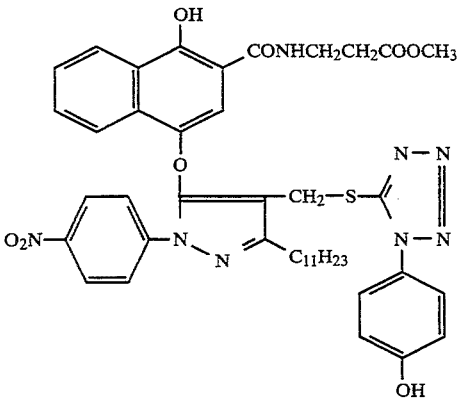

-continued
D-3
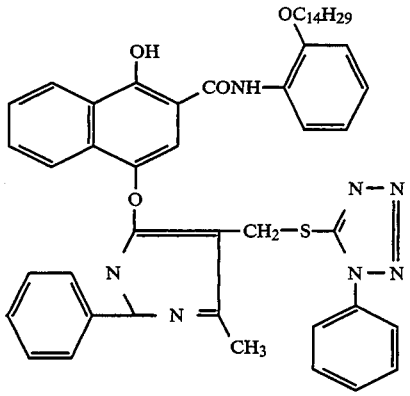
Oil-1
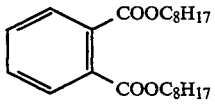
Oil-2
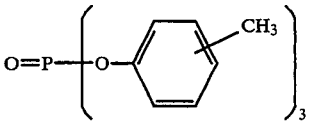
Oil-3
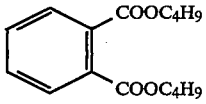
SC-1
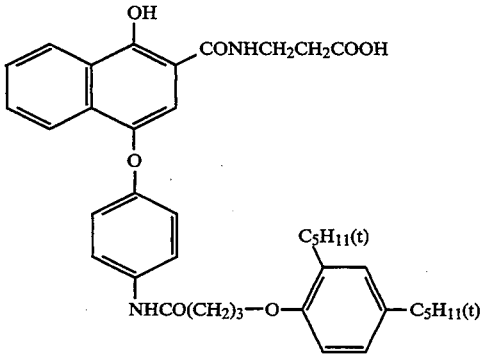
SC-2
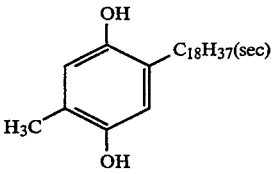
UV-1
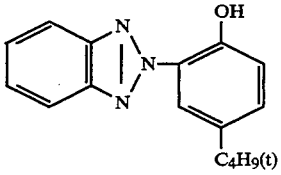
UV-2
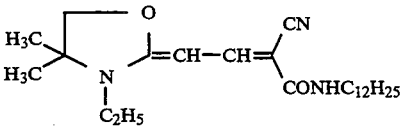

-continued
WAX-1
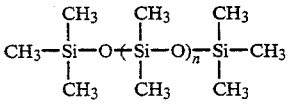
Weight average molecular weight Mw = 3,000
Su-1
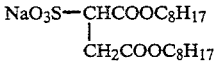
Su-2
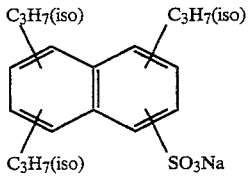
HS-1
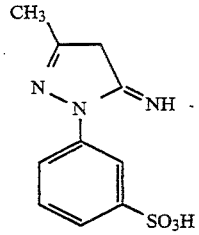
SD-1
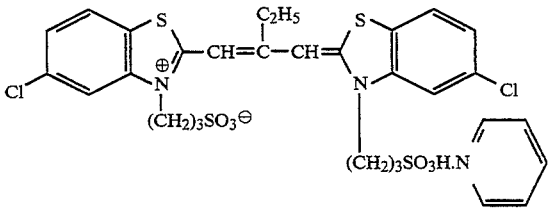
SD-2
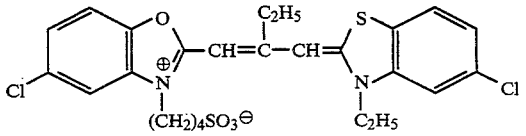
SD-3
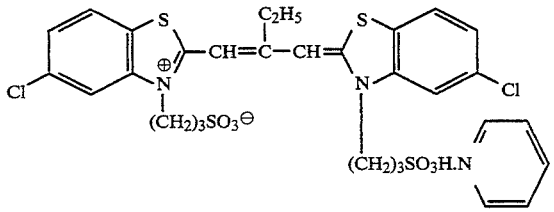
SD-4
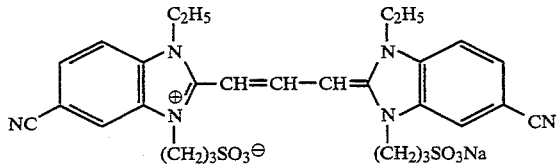
SD-5
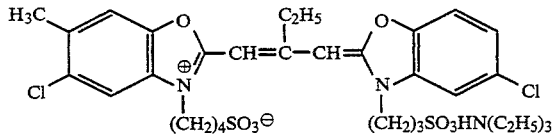

-continued
SD-6
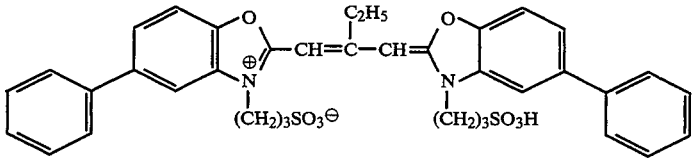
SD-7
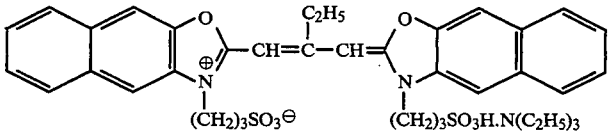
SD-8
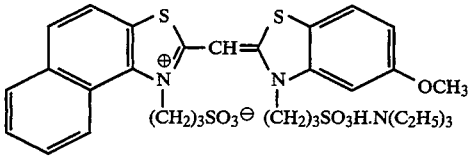
SD-9
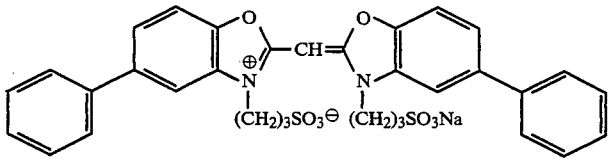
H-1
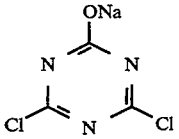
$(CH_2{=}CHSO_2CH_2)_2O$ H-2
ST-1
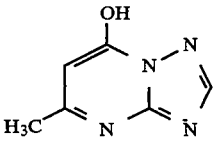
AF-1
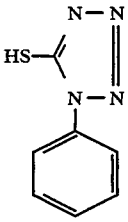
AF-2
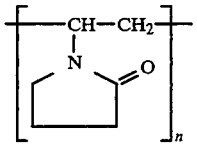
n: Polymerization degree
DI-1 (A mixture of the following three constituents)
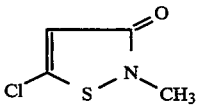
(Constituent A)
-continued
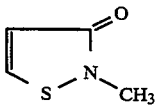
(Constituent B)

-continued

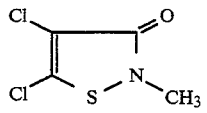

(Constituent C)

A:B:C=50:46:4 (molar ratio)

Preparation of Samples 102 to 104:

Sample 102 was prepared in the same manner as in Sample 101 except that the Em-A of Layers 5, 9 and 14 was replaced by Em-B.

Sample 103 was prepared in the same manner as in Sample 101 except that the Em-A of Layers 5, 9 and 14 was replaced by Em-C.

Sample 104 was prepared in the same manner as in Sample 101 except that the Em-A of Layers 5, 9 and 14 was replaced by Em-D.

Sample 105 was prepared in the same manner as in Sample 101 except that the Em-A of Layers 5, 9 and 14 was replaced by Em-E.

The above prepared samples were evaluated in the following procedure.

Photoconductivity Measurement

Two 35×145 mm-size sheets of each sample were allowed to stand under conditions of 23° C./55% RH for a period of 4 hours. After that, one of the sheets was subjected to microwave photoconductivity measurement, and the obtained induced absorption peak was designated as a.

The other sheet was placed with its emulsion side up on a sample-holding area 23 of the aforementioned folding evaluation device shown in FIG. 1. The sample was folded over with its emulsion side in to have a 6 mm-wide longitudinal area thereof undergo pressure treatment by being nipped between plates 21 and 22 which are pivotably joined with a hinge 24. Then, the sample was taken out from the device and allowed to stand for an hour. The pressure-applied area was cut to 5 mm×20 mm size to be subjected to microwave photoconductivity measurement, and the obtained induced absorption peak was designated as b. The b/a value of each sample is shown in Table 3.

Evaluation of Desensitization by Pressure

Each sample was allowed to stand under conditions of 55% RH and 23° C. for 4 hours. The sample, after being scratched by means of a scratch tester, was exposed through an optical wedge to a white light, and then processed according to the following procedure. The nonscratched area having a Dmax+0.4 density of each sample was measured scanning across its scratched part by means of a microdensitometer to thereby find variation of the density differences due to the scratch; the measured values of these samples are shown in values relative to the value of Sample 101 set at 100; the smaller the value, the better. The above measurement was performed with respect to blue, green and red colors.

Sensitivity/Fog Measurement

Each sample was subjected to the usual exposure (1/100 sec.) through a step wedge for sensitometry use, and then processed in the following procedure. The reciprocal of the exposure amount giving the fog +0.4 density of each sample was regarded as its sensitivity. The sensitivities of the samples thus obtained are shown in values relative to the value of Sample 101 set at 100 in Table 3. The density measurement was conducted with respect to blue, green and red colors.

| Processing<br>Processing step (38° C.) | |
|---|---|
| Color developing | 3 min. 15 sec. |
| Bleaching | 6 min. 30 sec. |
| Washing | 3 min. 15 sec. |
| Fixation | 6 min. 30 sec. |
| Washing | 3 min. 15 sec. |
| Stabilizing | 1 min. 30 sec. |
| Drying | |

The compositions of the processing solutions used in the above processing steps are as follows:

| | |
|---|---|
| Color developer | |
| 4-Amino-3-methyl-N-ethyl-N-(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate, monohydrate | 2.5 g |
| Potassium hydroxide | 1.0 g |
| Water to make 1 liter (pH 10.0) | |
| Bleaching bath | |
| Ferric ammonium ethylenediaminetetraacetate | 100.0 g |
| Diammonium ethylenediaminetetraacetate | 10.0 g |
| Ammonium bromide | 150.0 g |
| Glacial acetic acid | 10.0 ml |
| Water to make 1 liter | |
| Adjust pH to 6.0 with ammonia water | |
| Fixing bath | |
| Ammonium thiosulfate | 175.0 g |
| Anhydrous sodium sulfite | 8.5 g |
| Sodium metasulfite | 2.3 g |
| Water to make 1 liter | |
| Adjust pH to 6.0 with acetic acid | |
| Stabilizing bath | |
| Formalin (37% solution) | 1.5 ml |
| Koniducks (product of KONICA Corp.) | 7.5 ml |
| Water to make 1 liter | |

TABLE 3

| Sample | Microwave photoconductivity | Evaluation of pressure desensitization | | | Relative sensitivity | | |
|---|---|---|---|---|---|---|---|
| No. | b/a | B | G | R | B | G | R |
| 101 (Comp.) | 0.72 | 100 | 100 | 100 | 100 | 100 | 100 |
| 102 (Comp.) | 0.75 | 94 | 93 | 93 | 86 | 87 | 87 |
| 103 (Comp.) | 0.78 | 93 | 93 | 92 | 98 | 98 | 100 |
| 104 (Comp.) | 0.79 | 92 | 91 | 92 | 102 | 101 | 101 |
| 105 (Inv.) | 0.91 | 80 | 76 | 78 | 120 | 126 | 124 |

As is apparent from Table 3, Sample 105 of the invention shows less pressure desensitizations and higher sensitivities, and thus is better than the comparative samples.

What is claimed is:

1. A silver halide light-sensitive photographic material comprising:

a support having provided thereon a silver halide emulsion layer, said silver halide emulsion layer comprising silver iodobromide grains, wherein an induced absorption peak A obtained by a microwave photoconductive measurement of said light-sensitive photographic material and, an induced absorption peak B obtained by the microwave photoconductive measurement of said light-sensitive photographic material under pressure treatment, satisfies the following relationship;

$B/A \geqq 0.85$.

2. The photographic material of claim 1 wherein said silver halide emulsion layer further satisfies at least one condition selected from the group consisting of:

(a) $J_1 > J_2$ wherein $J_1$ represents the average silver iodide content of a grain obtained by an X-ray fluorescence analysis and $J_2$ represents a silver iodide content obtained by an X-ray photoelectron spectroanalysis, (b) $J_1 > J_3$ wherein $J_1$ represents the average silver iodide content obtained by the X-ray fluorescence analysis, and $J_3$ represents the average silver iodide content of spots 80% away from a center of the grain in a radius obtained by the X-ray microanalysis, (c) a continuous signal generation, not weaker than a peak height X 0.13 for a diffraction angle 2Θ of not less than 1.5, of X-ray diffractometry using CuKα, (d) having a relative standard deviation of silver iodide content of the individual silver halide grains of not more than 20%.

3. The material of claim 2 wherein the continuous signal generation is not weaker than the peak height ×0.15 for a diffraction angle of not less than 1.5.

4. The material of claim 3 wherein the diffraction angle 20 is not less than 2.0.

5. The material of claim 2 wherein the relative standard deviation is not more than 15%.

6. The material of claim 5 wherein the relative standard deviation is not more than 12%.

7. The material of claim 1 wherein an average grain diameter of the silver halide emulsion layer is 0.1 to 10 μm.

8. The material of claim 7 wherein the diameter is 0.1 to 5.0 μm.

9. The material of claim 1 wherein the silver halide emulsion is prepared by a fine grain supply method.

10. The silver halide light-sensitive photographic material of claim 1 comprising:

a support having provided thereon a silver halide emulsion layer formed of an emulsion comprising silver iodobromide grains, wherein iodine is added in an amount of 0.2 to 200 mg per mol of Ag during formation of said emulsion.

11. The material of claim 10 wherein said iodine is added in an amount of 0.5 to 100 mg per 1 mol of Ag.

12. The silver halide light-sensitive photographic material of claim 1 comprising:

a support having provided thereon a silver halide emulsion layer comprising silver iodobromide in a dispersion medium, wherein a content of a reductive substance in said dispersion medium, in terms of an amount of $SO_2$ equivalent contained in 1 kg of said dispersion medium, is 5 to 15 mg.

13. The material of claim 1 wherein said silver halide light-sensitive photographic material comprises a silver halide emulsion formed under the following conditions:

(a) an inert gelatin, containing a reductive substance in an amount of 5 to 15 mg, in terms of an amount of $SO_2$ equivalent contained in 1 kg of said gelatin, is used (b) $4.76 \times 10^{-6}$ mols per mol Ag of iodine are added in a methanol solution one minute before an addition of a seed emulsion, (c) pH and pAg are controlled as shown in the Table below;

| Time lapse in minute | Start | 110 | 111 | 123 | 138 | 146 | 163 |
|---|---|---|---|---|---|---|---|
| pH | 7.0 | 7.0 | 6.0 | 6.0 | 6.0 | 6.0 | 6.0 |
| pAg | 7.8 | 7.8 | 9.7 | 9.8 | 10.0 | 10.1 | 10.1. |

* * * * *